US009410373B2

(12) United States Patent
Randolph

(10) Patent No.: US 9,410,373 B2
(45) Date of Patent: Aug. 9, 2016

(54) LADDER GUARD

(76) Inventor: Sandra Randolph, Memphis, TN (US)

( * ) Notice: Subject to any disclaimer, the term of this patent is extended or adjusted under 35 U.S.C. 154(b) by 0 days.

(21) Appl. No.: 13/158,391

(22) Filed: Jun. 11, 2011

(65) Prior Publication Data

US 2012/0312635 A1 Dec. 13, 2012

(51) Int. Cl.
*E06C 7/00* (2006.01)

(52) U.S. Cl.
CPC ..... *E06C 7/006* (2013.01)

(58) Field of Classification Search
CPC ..... E06C 7/006
USPC ..... 248/74.2
See application file for complete search history.

(56) References Cited

U.S. PATENT DOCUMENTS 3,225,863 A 12/1965 Ludlow
3,303,906 A 2/1967 Bouwmeester
3,311,195 A 3/1967 Singer
3,372,772 A 3/1968 Singer
4,116,411 A * 9/1978 Masuda ..... 248/60
4,126,206 A 11/1978 Becnel
4,181,195 A 1/1980 Clarke
4,579,197 A 4/1986 Spurling
4,991,691 A 2/1991 Brawer
5,421,428 A 6/1995 Ingles
5,441,126 A 8/1995 Orrick
5,575,353 A 11/1996 Cafaro
5,832,755 A 11/1998 Crilly
6,880,674 B1 4/2005 St-Hilaire
D525,369 S 7/2006 Houze
7,637,472 B2 * 12/2009 Endo ..... 248/610
7,658,350 B2 * 2/2010 Bauer ..... 248/65
7,717,231 B2 5/2010 Horton
7,793,759 B1 9/2010 Aiken, Jr.
8,245,845 B1 * 8/2012 Huddleston ..... 206/363

* cited by examiner

*Primary Examiner* — Alvin Chin-Shue

(57) ABSTRACT

A ladder guard secured between the rungs and stringers of the ladder to prevent use of the rungs as footholds or handholds and deter ascension of the ladder, especially by children. The ladder guard is constructed from compressible material of a desired resiliency allows an adult to deform the invention for insertion or removal between two adjacent stringers.

6 Claims, 7 Drawing Sheets

LADDER GUARD

BACKGROUND OF THE INVENTION

This invention relates generally to devices which prevent unauthorized access to ladders. More particularly, it relates to a modular device that attaches to a ladder obstructing access preventing children from accessing the rungs of the ladder.

Ladders create an attractive nuisance because young children perceive ladders as obstacles or toys which are to be climbed upon but the ladders present dangers that are not fully comprehended by young children including falls and access to dangerous and equally enticing areas such as swimming pools or spas. While parental supervision and fences can help prevent accidents, ladder guards can provide an additional layer of safety by deterring a child's attempt to climb.

Previous attempts at preventing unauthorized use of ladders include ladder rung covers and complex folding rung mechanisms. These devices and methods, however, can be cumbersome, difficult to use, complex and/or prohibitively expensive.

Ladder rung covers are generally single panels that are clamped, bolted or strapped or hinged to the ladder. The guards block access to the rungs, preventing a person from using the ladder. The cover's size weight and fastening mechanisms can make it unwieldy and cumbersome for a person to attach and remove and once removed, must be secured in a safe location to prevent stumbling upon or damage.

Folding ladder rung mechanisms also can prevent unauthorized access, however such mechanisms can be expensive to construct and maintain with multiple moving parts. Such mechanisms are not readily adaptable to existing ladders, thus require entire replacement of the ladder.

Thus there exists a need for a ladder guard that can easily be attached or detached by an adult, but prevent small children from accessing the ladder, that possesses no moving parts, can be adapted to existing ladder systems, and once removed can be left in or near the ladder without presenting a danger to others.

BRIEF SUMMARY OF THE INVENTION

The disclosed ladder guard is secured between the rungs and stringers of the ladder to prevent use of the rungs as footholds or handholds and deter ascension of the ladder, especially by children. The invention is comprised of a compressible material of a desired resiliency allowing an adult to deform the invention for insertion or removal between two adjacent stringers. The left and right sides of the invention completely or partially surround the left and right stringers of the ladder to deter the invention's dislodgment by the would-be ladder user.

BRIEF DESCRIPTION OF THE DRAWINGS

The invention is illustrated by the accompanying drawings, in which.

DETAILED DESCRIPTION OF THE INVENTION

The drawings illustrate an invention that enables an individual to restrict access to a ladder, especially to restrict a child's access.

Figure 1:
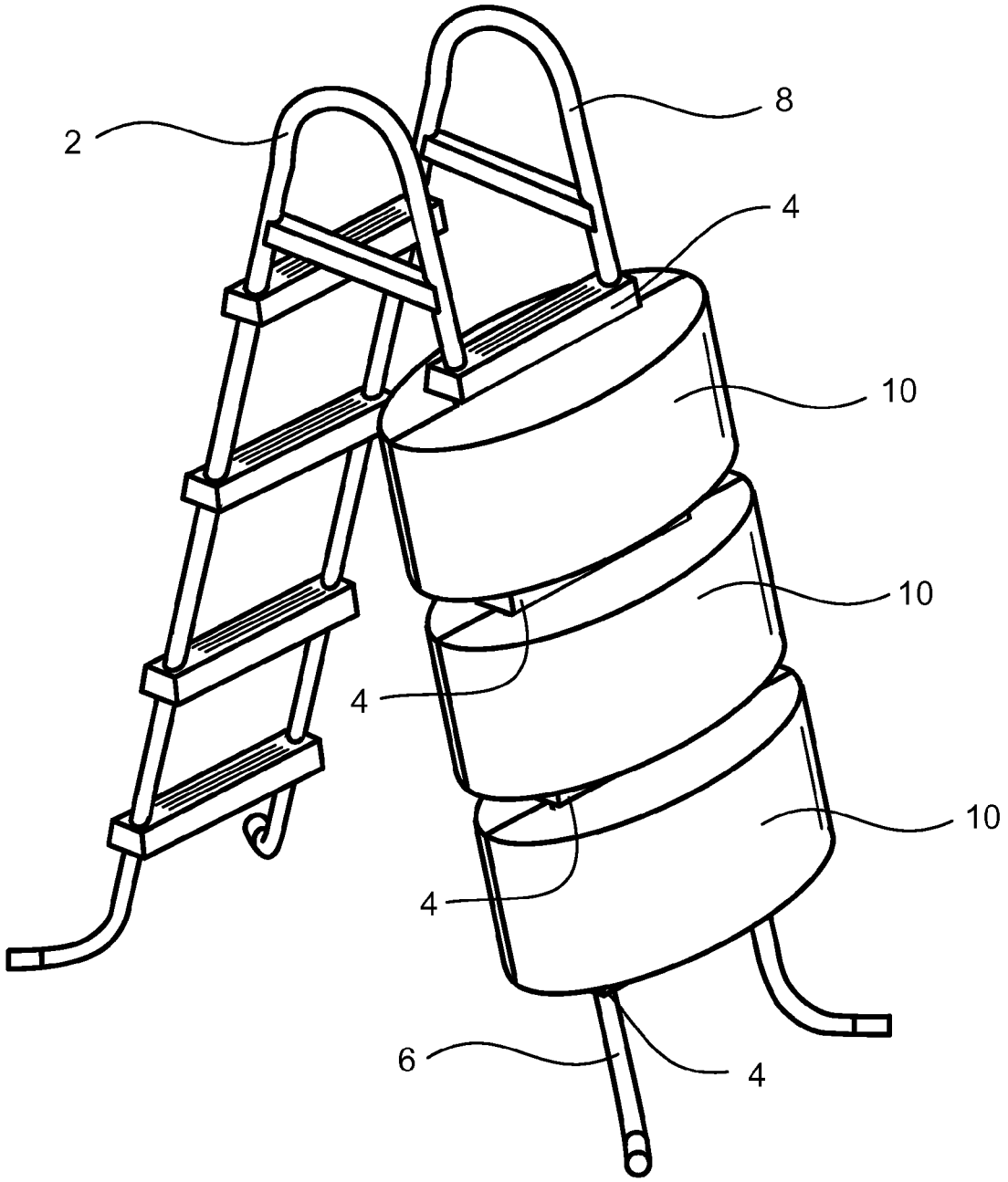
FIG. 1 is a perspective view of three units of a first embodiment of the invention attached to a typical pool ladder.

FIG. 1 shows a first embodiment of the present invention in the form of a resilient modular ladder guard 10 attached to a typical above ground pool ladder 2. While a typical pool ladder is illustrated in the following figures, it should be understood that the invention may be employed with any ladder having a rung 4 and stringers 6, 8.

The modular guard 10 is placed between two adjacent rungs 4 of the ladder 2 to prevent a small child from easily climbing the ladder 2. The module 10 is modular and the number of units can be increased or decreased depending upon the number of rungs 4 of the ladder 2 needing to be obstructed. Preferably, each unit is constructed of a resilient foam material. The height of each unit is sized to fit the intended ladder, or can be cut to fit by the end user to fit the particular ladder's rung spacing.

Figure 2:
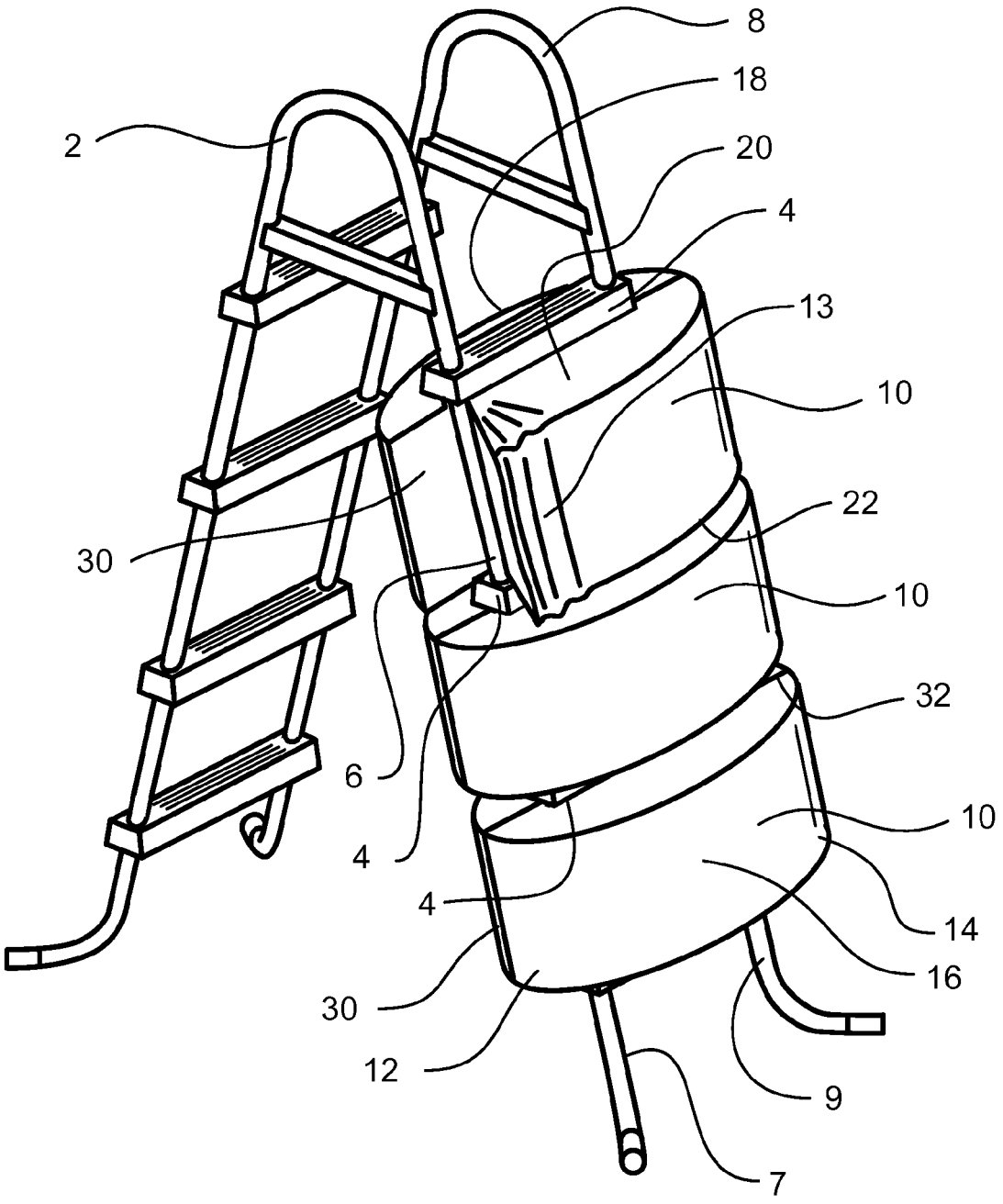
FIG. 2 is a perspective view of the first embodiment of the invention showing the invention partially compressed for insertion or removal.

FIG. 2 shows the module 10 as it is being installed upon the ladder 2. The module 10 fits between the left stringer 6 and right stringer 8. The module 10 possesses a left invagination 30 such as an indentation, crevasse, fold or slit on its left side 12 and a right invagination 32 on its right side 14 that allows the left side 12 to receive the left stringer 6 by extending past the left stringer 6 medial surface 7 and allows the right side 14 to receive the right stringer 8 by extending past the right stringer 8 medial surface 9, preventing the module 10 from becoming dislodged by pushing on its front surface 16 or rear surface 18. Here the invaginations 30, 32 are shown as slits cut into the left and right sides 12, 14 and extending from the top surface 20 to the bottom surface 22 providing a passageway that accommodates the left and right stringers 6, 8. The invaginations, or slits 30, 32 extend toward each other a sufficient amount to allow each unit 10 to be positioned between the stringers 6, 8 of the ladder 2.

Insertion or removal of the modular unit 10 requires compression of a side 12 or 14 or portion thereof of the unit 10. The material each unit 10 is constructed of provides sufficient resistance to compression such that a typical small child would not possess sufficient strength to dislodge the unit 10, but is sufficiently compressible or flexible to allow an adult to compress and dislodge the unit 10 with moderate force. Here a portion of the left side 12 is compressed. The compressed portion 13 allows the unit 10 to rotate about the right stringer 8 and subsequently be removed.

Figure 3:
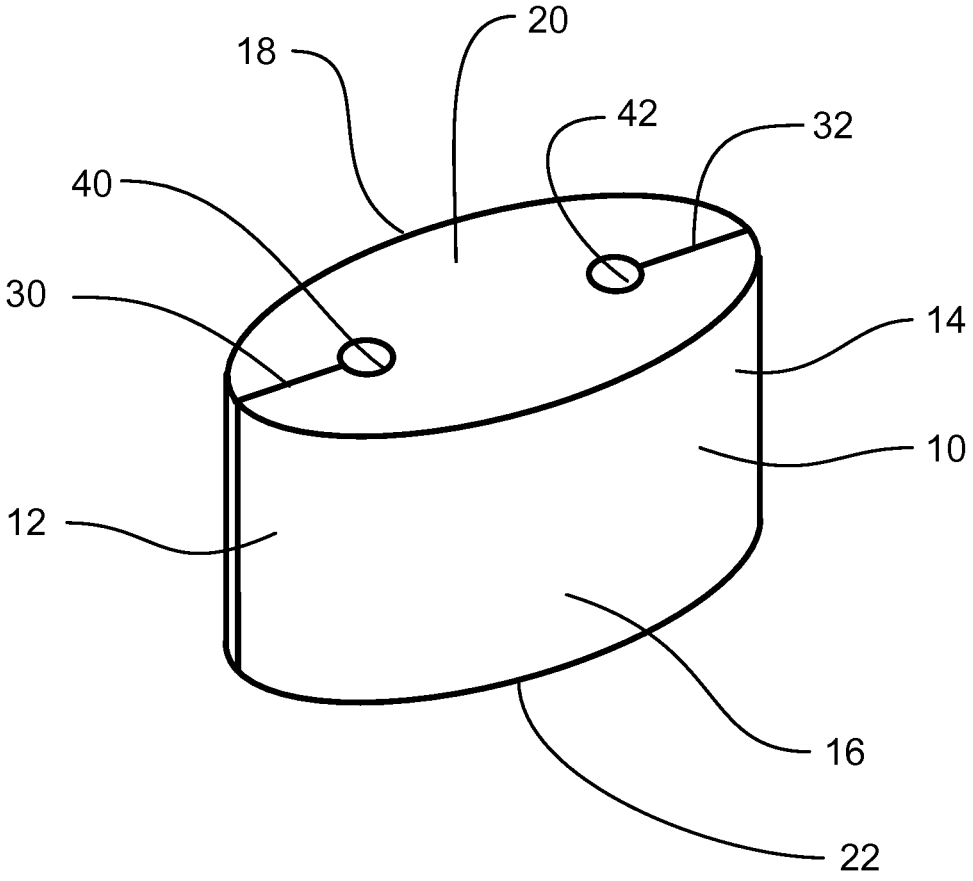
FIG. 3 is a front perspective view of the first embodiment of the invention.

FIG. 3 shows a perspective view of the module 10. The module 10 preferably possesses an elliptical or oval horizontal cross section as viewed from the top surface 20 or bottom surface 22. The horizontal cross section could also be square, rectangular, octagonal or other desired shape. Here the invention is shown having an elliptical horizontal cross section with the major diameter oriented generally parallel to the width of the ladder, the invention possessing straight vertical left, right, front and rear surfaces, 12, 14, 16, and 18. The elliptical cross section discourages individuals from grasping the corners of the invention to aid in climbing.

The left invagination 30 begins at the left surface 12 and extends inward terminating at a left cylindrical surface 40. Likewise the right invagination 32 begins at the right surface 14 and extends inward terminating at a right cylindrical surface 42. The cylindrical surfaces 40, 42 and indentions 30, 32 extend from the top surface 20 to the bottom surface 22. The cylindrical surfaces 40, 42 are shown here as having a circular cross-section forming a cylindrical shaped aperture extending from the top surface 20 to the bottom surface 22, but may alternatively have other cross section including an elliptical cross section, that form a complimentary fit with the stringers of the ladder.

Figure 4A:
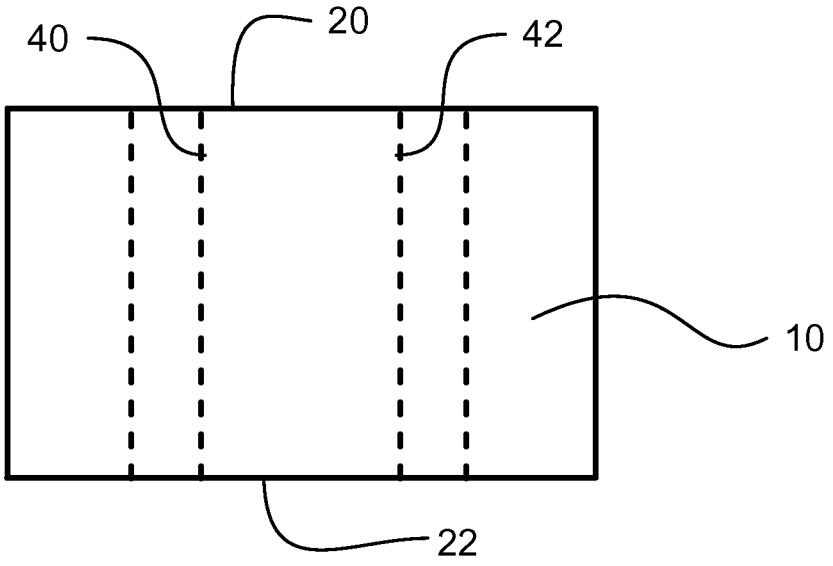
FIG. 4A is a front view of the first embodiment of the invention.

FIG. 4A shows a front view of the module 10. The walls of the cylinder holes 40, 42 extend from the top surface 20 to the bottom surface 22 and are shown by the hidden lines.

Figure 4B:
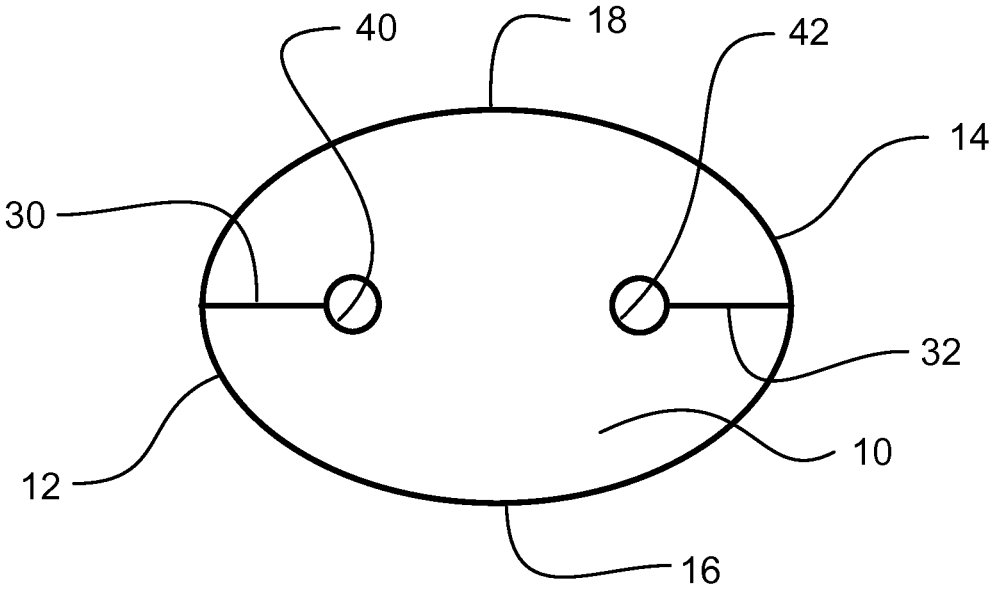
FIG. 4B is a top view of the first embodiment of the invention.

FIG. 4B shows a top view of the invention showing the upper edge of the left surface 12, right surface 14, front surface 16 and rear surface 18. The left invagination or slit 30 extends from the left surface 12 to the left cylindrical surface 40. The right invagination or slit 32 extends from the right surface 14 to the right cylindrical surface 42.

Figure 5:
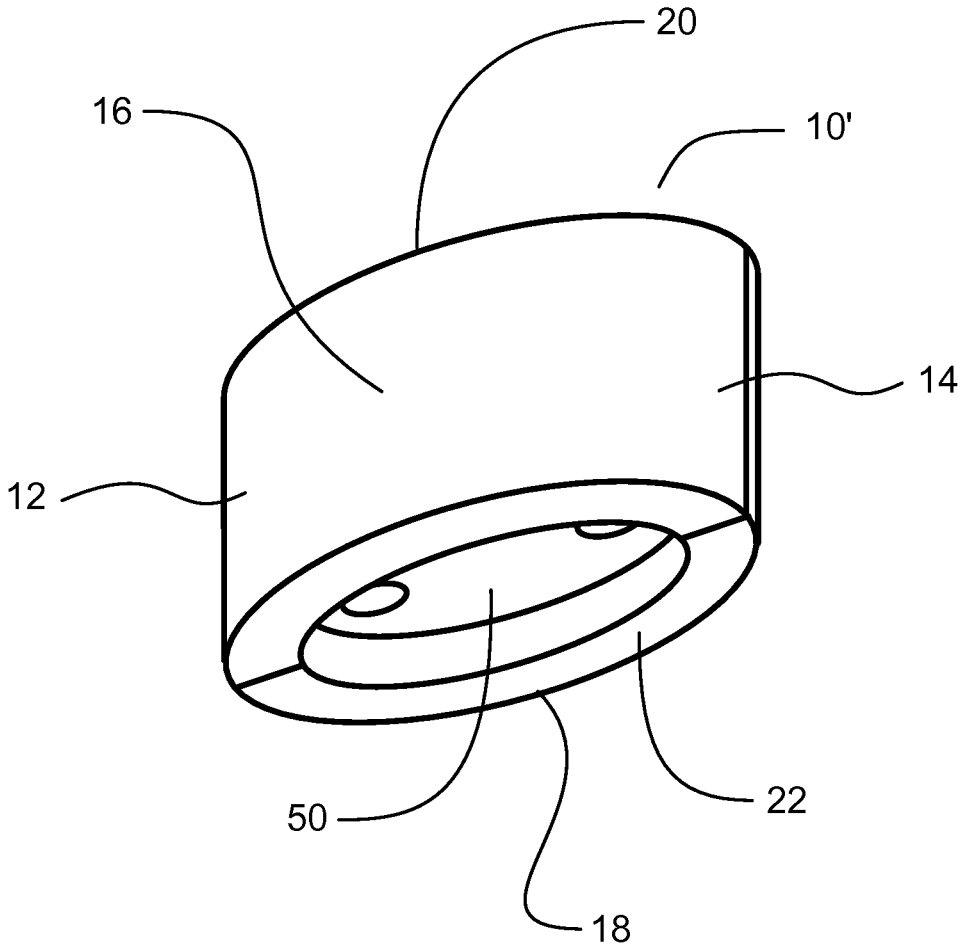
FIG. 5 is a bottom perspective view of a second embodiment of the invention.

FIG. 5 shows a second embodiment of the invention having a recessed cutout portion 50 in the bottom surface 22 of the module 10'. The recessed portion 50 allows the outer surfaces 12, 14, 16, 18 of the invention to completely enclose the ladder rungs 4 of the ladder 2. While a recessed portion 50 is shown in the bottom surface 22 of the unit 10', a recessed portion may also be located in the upper surface 20 or both the upper surface 20 and lower surface 22.

The recessed portions 50 allow the upper surface 20 of a first unit to mate with the bottom surface 22 of a second unit without significant deformation, discouraging a person from using the upper surface 20 as a handhold or foot hold to climb.

Figure 6:
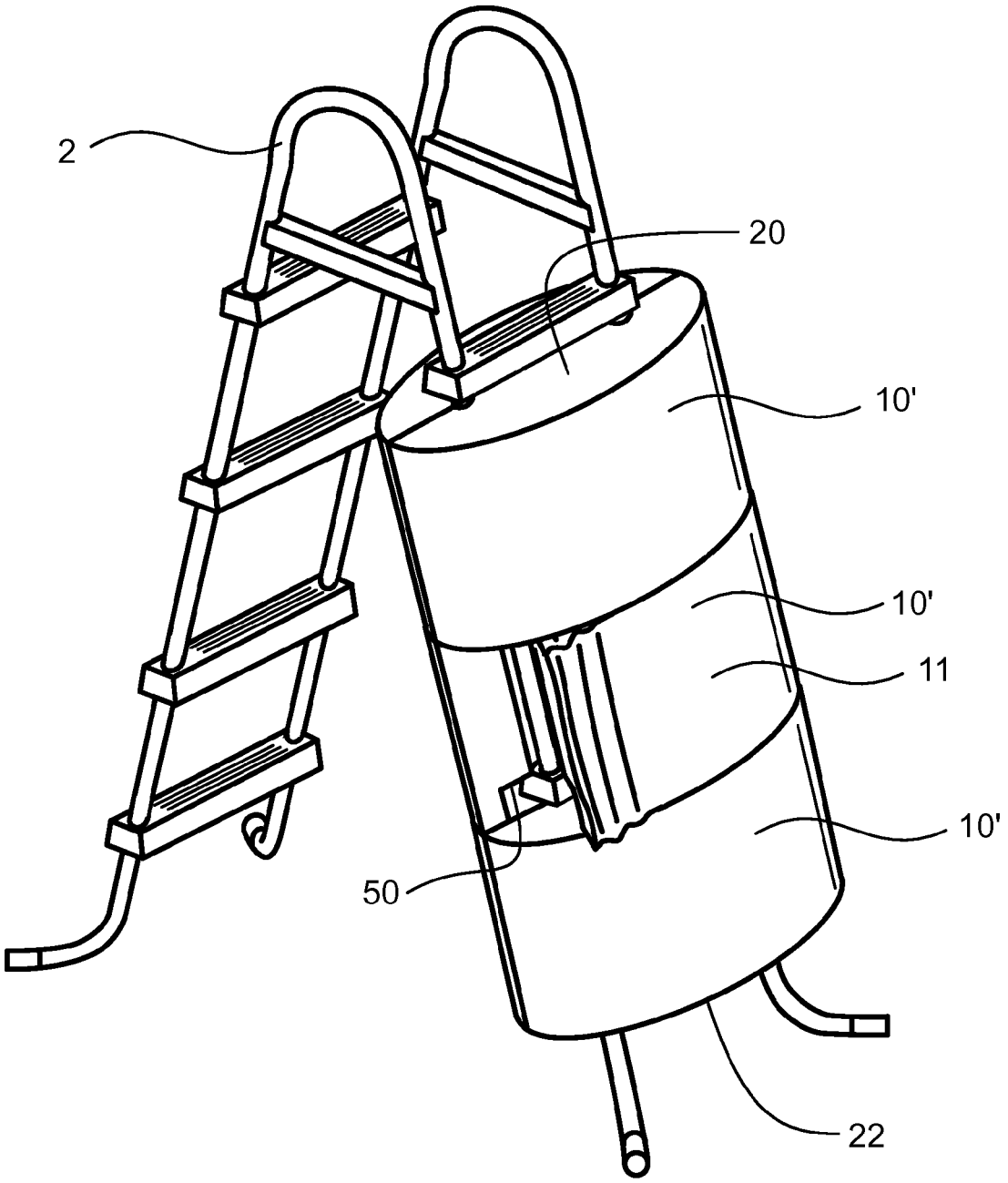
FIG. 6 is a perspective view of the second embodiment of the invention.

FIG. 6 shows the second embodiment of the module 10' attached to a ladder 2. The middle unit 11 is shown compressed for insertion or removal into or from the ladder 2. The recessed portion 50 minimizes or eliminates any gap between the upper surface 20 and lower surface 22 of any adjacent units 10.

Figure 7A:
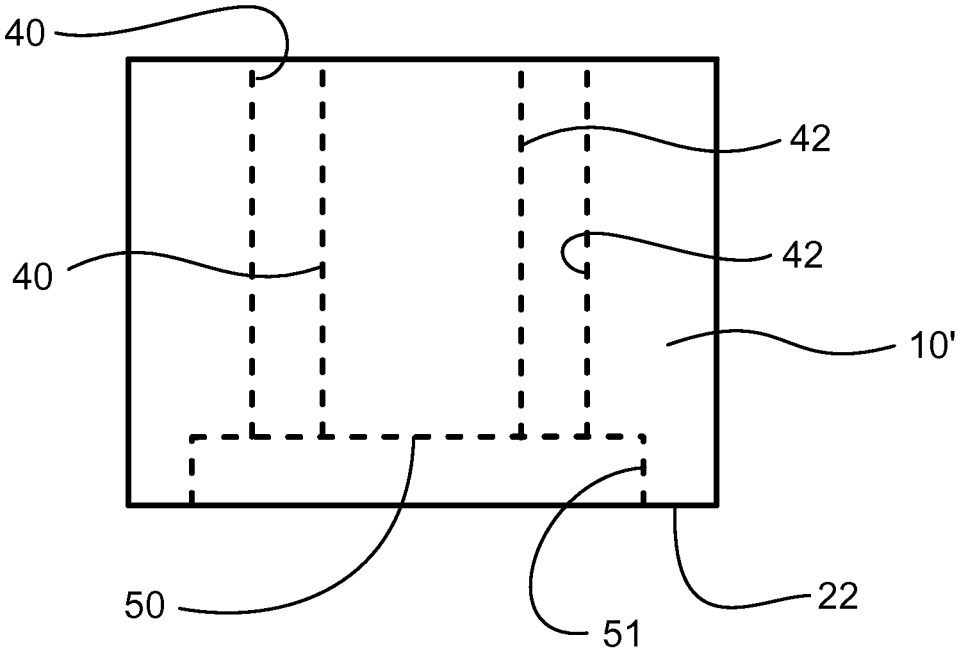
FIG. 7A is a front view of the second embodiment of the invention

FIG. 7A shows a side view of the second embodiment 10' of the invention with hidden lines showing the cylindrical surfaces 40, 42 and the vertical wall surface 51 of the recessed portion 50 at lower surface 22. The recessed portion 50 forms a cavity that may enclose a ladder rung 4.

Figure 7B:
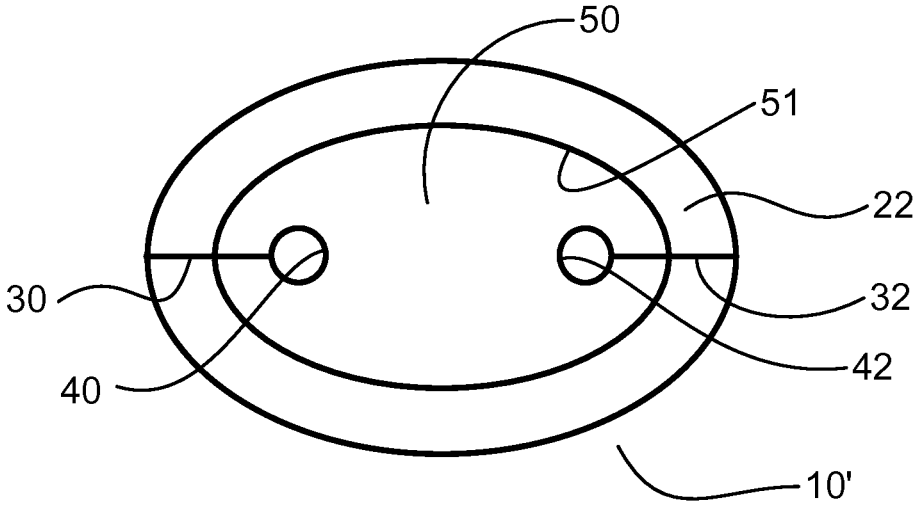
FIG. 7B is a bottom view of the second embodiment of the invention.

FIG. 7B shows a bottom view of the second embodiment 10' showing the recessed portion 50, left invagination slit 30 and left cylindrical hole 40 and right invagination slit 32 and right cylindrical hole 42 and bottom surface 22. The recessed portion 50 of the lower surface 22 is shaped to allow the ladder rung 4 to preferably fit within the cavity of the recessed portion inner surface wall 51.

The ladder guard invention's preferred construction from a compressible foam material creates a device that is lightweight, buoyant and durable. Such characteristics allow it to be used as a toy or otherwise handled roughly with a minimal concern for damage to the unit or injury to others.

What is claimed is:

1. A modular safety device for preventing unauthorized access of a ladder, comprising:

a ladder having a first stringer, a second stringer and a plurality of rungs connecting and perpendicular to said first and second stringers;

a modular unit constructed from resilient material having a top surface, a bottom surface, a left side surface, a right side surface, a front surface and a back surface;

a first vertically oriented slit extending into said left side surface extending from said top surface to said bottom surface of said unit, said first vertically oriented slit receiving said first stringer; and a second vertically oriented slit extending into said right side surface extending from said top surface to said bottom surface of said unit, said second vertically oriented receiving said second stringer, said second vertically oriented slit being separate from said first vertically oriented slit, wherein said first vertically oriented slit extends from an outer surface of said left side surface of said unit to a first vertically oriented cylindrical surface formed within said unit and extending from said top to said bottom and said second vertically oriented slit extends from an outer surface of said right side surface of said unit to a second vertically oriented cylindrical surface formed within said unit and extending from said top to said bottom, wherein said unit possesses an elongated recessed portion in said top surface or said bottom surface, said elongated recessed portion having an elongated shape which is longer in length in a direction from said right side surface to said left side surface than it is wider in width in a direction from said front surface to said back surface, said recessed portion receiving a said rung of said ladder.

2. The modular safety device of claim 1, wherein said unit possesses an elliptical cross section when viewed from the top or bottom.

3. The modular safety device of claim 1 wherein said resilient material is compressible foam.

4. A method of preventing unauthorized access of a ladder, said ladder having a first stringer, a second stringer and a plurality of rungs connecting and perpendicular to said first and second stringers, said method comprising compressing an at least one modular unit constructed from resilient material and placing said unit between said first stringer and said second stringer, wherein said at least one modular unit is constructed from resilient material having a top surface, a bottom surface, a left side surface, a right side surface, a front surface and a back surface, a first vertically oriented slit extending into said left side surface extending from said top surface to said bottom surface of said unit, said first vertically oriented slit receiving said first stringer; and a second vertically oriented slit extending into said right side surface extending from said top surface to said bottom surface of said unit, said second vertically oriented slit receiving said second stringer, said second vertically oriented slit being separate from said first vertically oriented slit, wherein said first vertically oriented slit extends from an outer surface of said left side surface of said unit to a first vertically oriented cylindrical surface formed within said unit and extending from said top to said bottom and said second vertically oriented slit extends from an outer surface of said right side surface of said unit to a second vertically oriented cylindrical surface formed within said unit and extending from said top to said bottom, wherein said unit possesses an elongated recessed portion in said top surface or said bottom surface, said elongated recessed portion having an elongated shape which is longer in length in a direction from said right side surface to said left side surface than it is wider in width in a direction from said front surface to said back surface, said recessed portion receiving a said rung of said ladder.

5. The method of claim 4, wherein said unit possesses an elliptical cross section when viewed from the top or bottom.

6. The method of claim 4 wherein said resilient material is compressible foam.

* * * * *